United States Patent [19]

Park

[11] Patent Number: 4,989,373

[45] Date of Patent: Feb. 5, 1991

[54] FLAT GLASS EDGING-BEVELLING MACHINE

[76] Inventor: Kyung Park, 305-1109 Jugong Apt. 670 Daichi-Dong, Kangnam-Ku Seoul, Rep. of Korea

[21] Appl. No.: 392,862

[22] Filed: Aug. 11, 1989

[30] Foreign Application Priority Data

Aug. 12, 1988 [KR] Rep. of Korea ..... 13262/1988[U]

[51] Int. Cl.[5] ..... B24B 5/00

[52] U.S. Cl. ..... 51/131.1; 51/283 E

[58] Field of Search ..... 51/131.1, 110, 240 GB, 51/240 T, 216 CP, 283 R, 283 E

[56] References Cited

U.S. PATENT DOCUMENTS 2,688,214 9/1954 Ogle et al. ..... 51/283 E
4,375,738 3/1983 Bando ..... 51/283 E
4,660,327 4/1987 Bando ..... 51/110
4,716,686 1/1988 Lisec ..... 51/240 GB

*Primary Examiner*—Frederick R. Schmidt
*Assistant Examiner*—M. Rachuba
*Attorney, Agent, or Firm*—Heslin & Rothenberg

[57] ABSTRACT

A flat glass edging-bevelling machine is employed for rounded cutting or working of peripheral areas of cut flat glass. By disposing major operation parts of the machine higher in elevation than the flat glass wearing or abrasion of major operational parts of the machine by falling glass powder and diamond abrasive grinding wheel powder mixed with cooling water and cutting oil, produced in edging and bevelling the flat glass, is avoided. The major operational parts include a bevel angle control means, a diamond abrasive grinding wheel height control means, a sagging-prevention roller positioning means and major articulated parts.

7 Claims, 14 Drawing Sheets

FLAT GLASS EDGING-BEVELLING MACHINE

BACKGROUND OF THE INVENTION

The present invention relates to a flat glass edging-bevelling machine which is used for rounded working or cutting peripheral areas of the flat glass into various shapes, after cutting the flat glass with a glass knife.

More particularly, the present invention relates to a flat glass edging-bevelling machine which is designed to prevent machine fouling by falling glass powder and diamond abrasive grinding wheel powder, mixed with cooling water and cutting oil, produced in edging-bevelling the glass, by disposing major operational parts of the machine higher than the flat glass in height, to allow convenient bevel adjustment without change of bevel width by placing the rotational center of the bevel angle control means on the lower part thereof, to enable adjustment of the height of the diawheel by selection of height control bolts, to prevent sagging of the flat glass by a taperedly formed roller positioned by an air cylinder, and to avoid the production of cracks or flaws in the flat glass.

In the prior arts, as shown in FIGS. 1A and 1B, an advanced articulation part (44), rail (45), roller and bevelling angle control means (12') as major operational parts of the flat glass edging-bevelling machine have been disposed lower than vacuum glass holder means (43) upon which the flat glass (42) is set. When glass (42) placed on holder means (43) is edged-bevelled the glass powder and diamond abrasive grinding wheel (41) powder produced in edging-bevelling the glass are mixed with cooling water and cutting oil and the resulting mixtures fall on the major operational parts causing problems, failures and shortening of machine life.

Further, because it is very difficult for general workers to perform edging-bevelling on the flat glass (42) with a weighty machine and apparatus, in the prior art devices motor (46) and a diamond abrasive wheel (41) are spacedly disposed.

Thus, because the motor and the diamond abrasive grinding wheel are interconnected by a belt or the like, vibration and noise are produced in providing power transmission. Owing to such production of vibration, small cracks and flaws are produced on the flat glass (42).

Further, one end of a roller (47) for prevention of sagging of the flat glass (42) is flatly formed, and when it comes into contact with the glass (42), quality of the glass is considerably reduced.

The present invention provides a flat glass edging-bevelling machine which aims to dispose major operational parts of the machine higher than a flat glass in height, directly attach a diawheel to a motor shaft connected to a height control plate, and permit control of the height of the diawheel and the bevel angle at a fixed position without change of the bevel width. An explanation thereof according to the drawings attached hereto will be given hereunder.

DETAILED DESCRIPTION

Figure 1A:
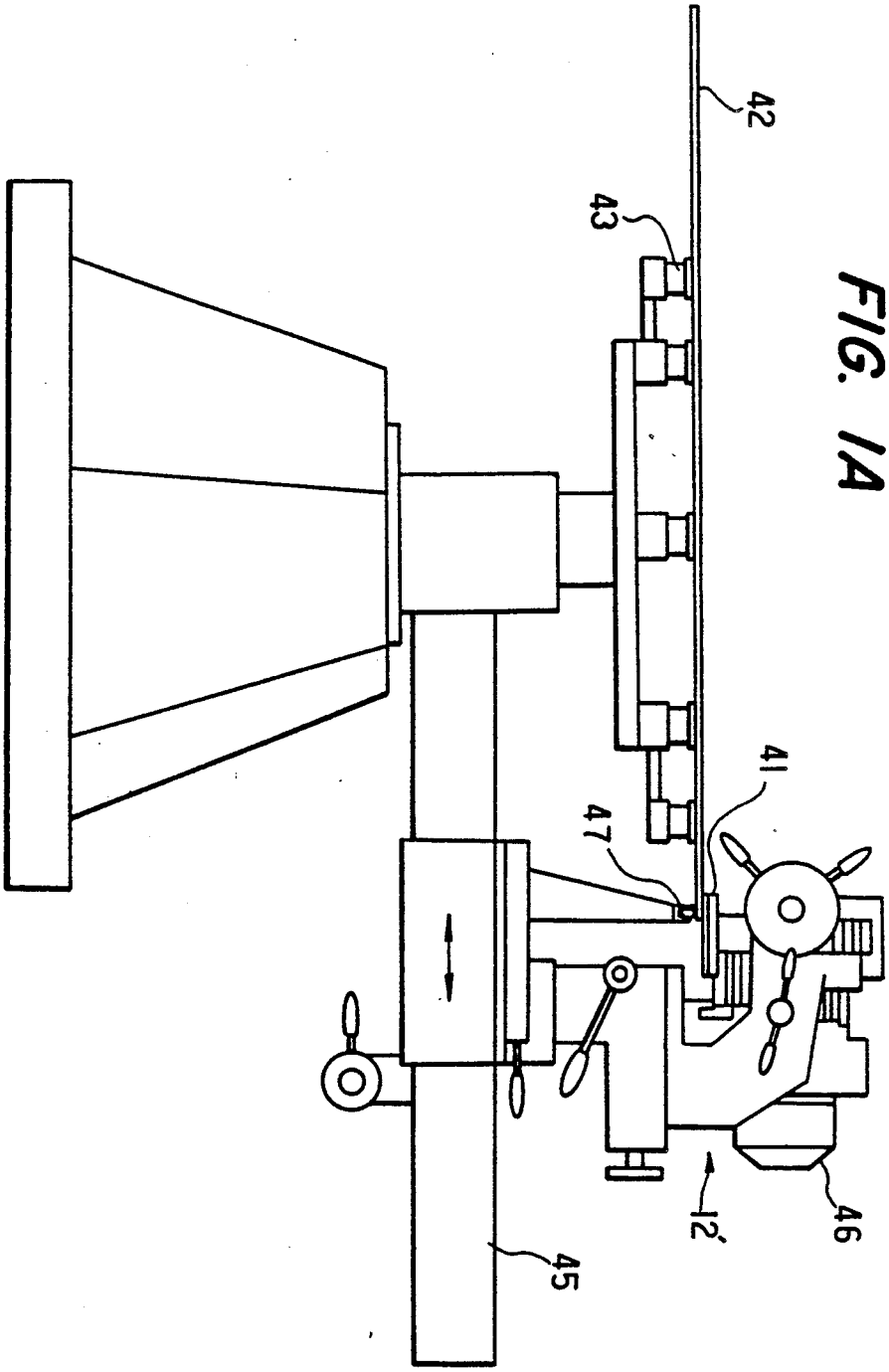
FIGS. 1(A) and FIG. 1(B) are front elevational views illustrating the prior art machine.
Figure 1B:
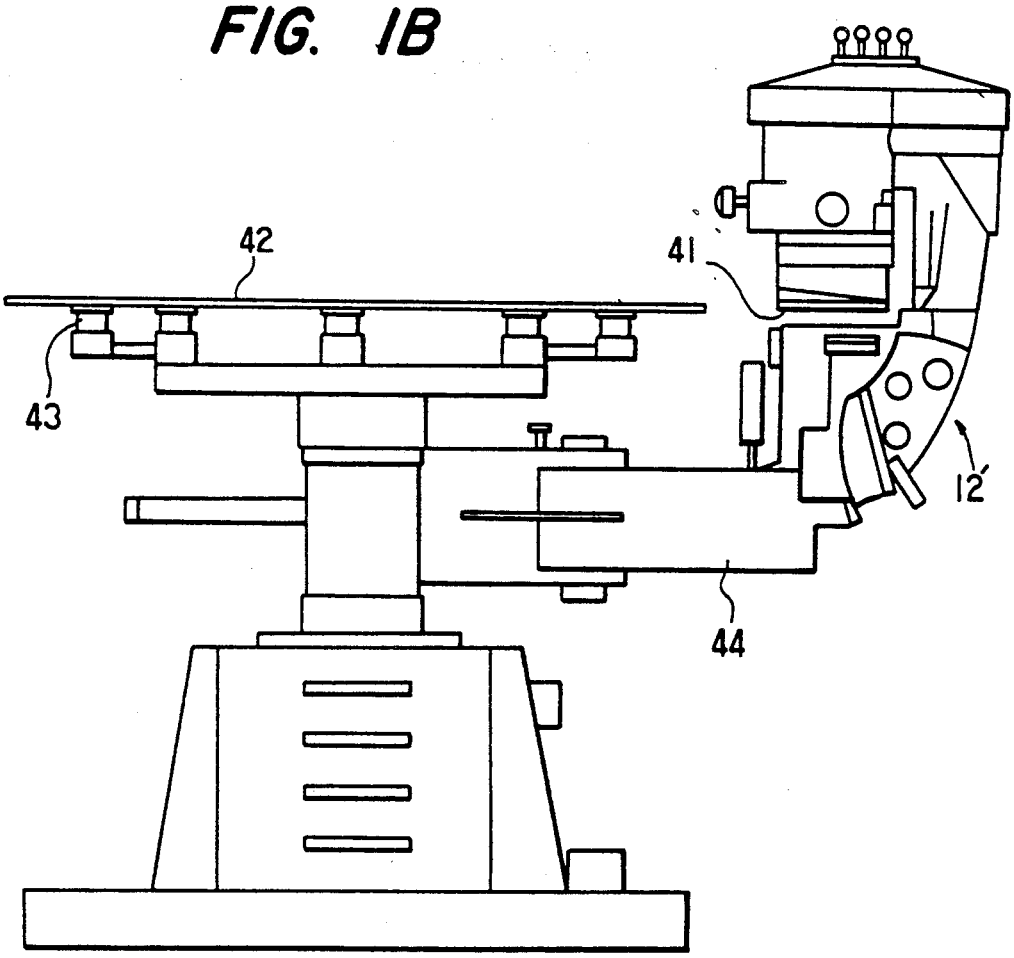
Figure 2A:
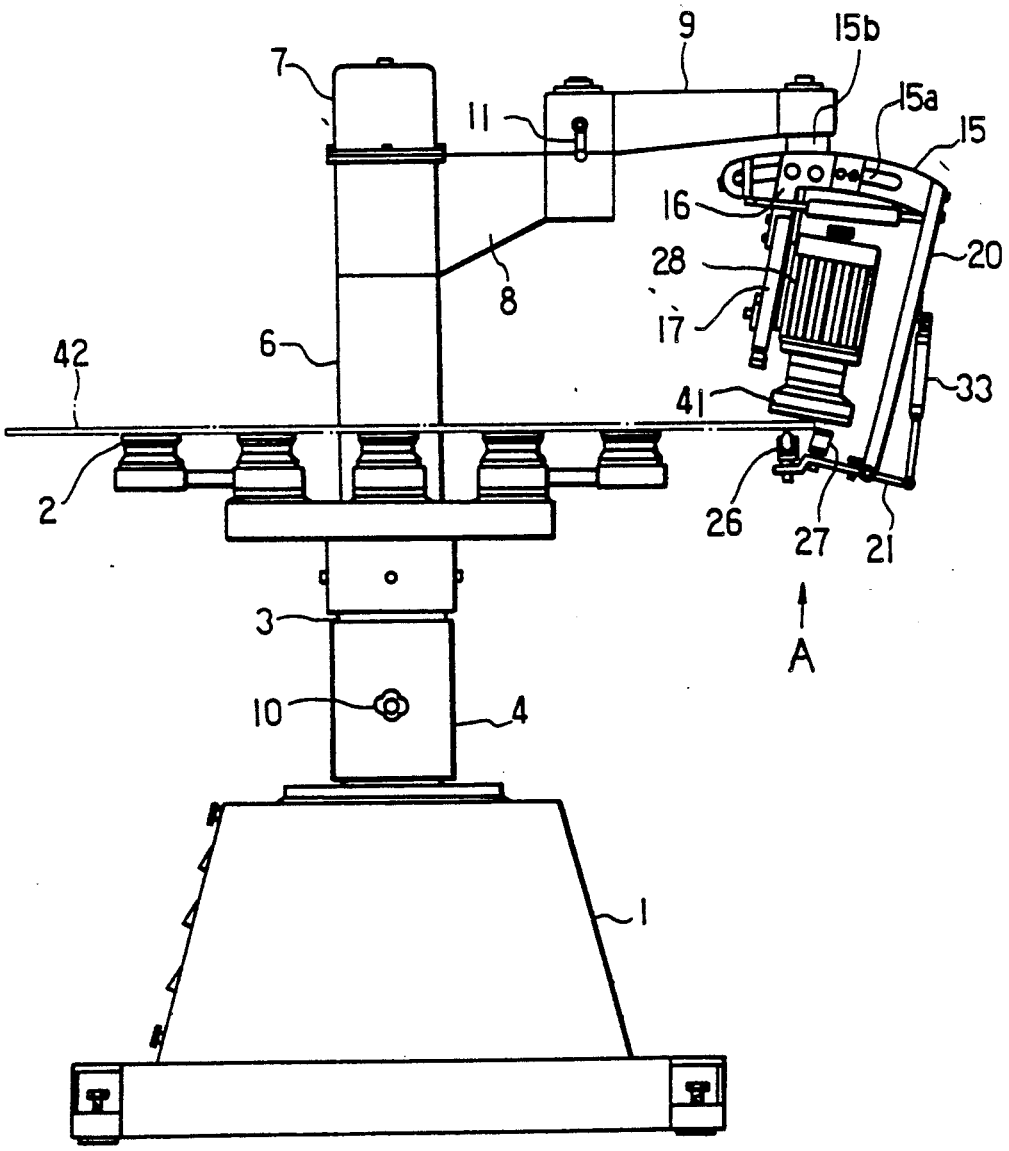
FIG. 2(A) is a front elevational view illustrating a flat glass edging-bevelling machine of the present invention.
Figure 2B:
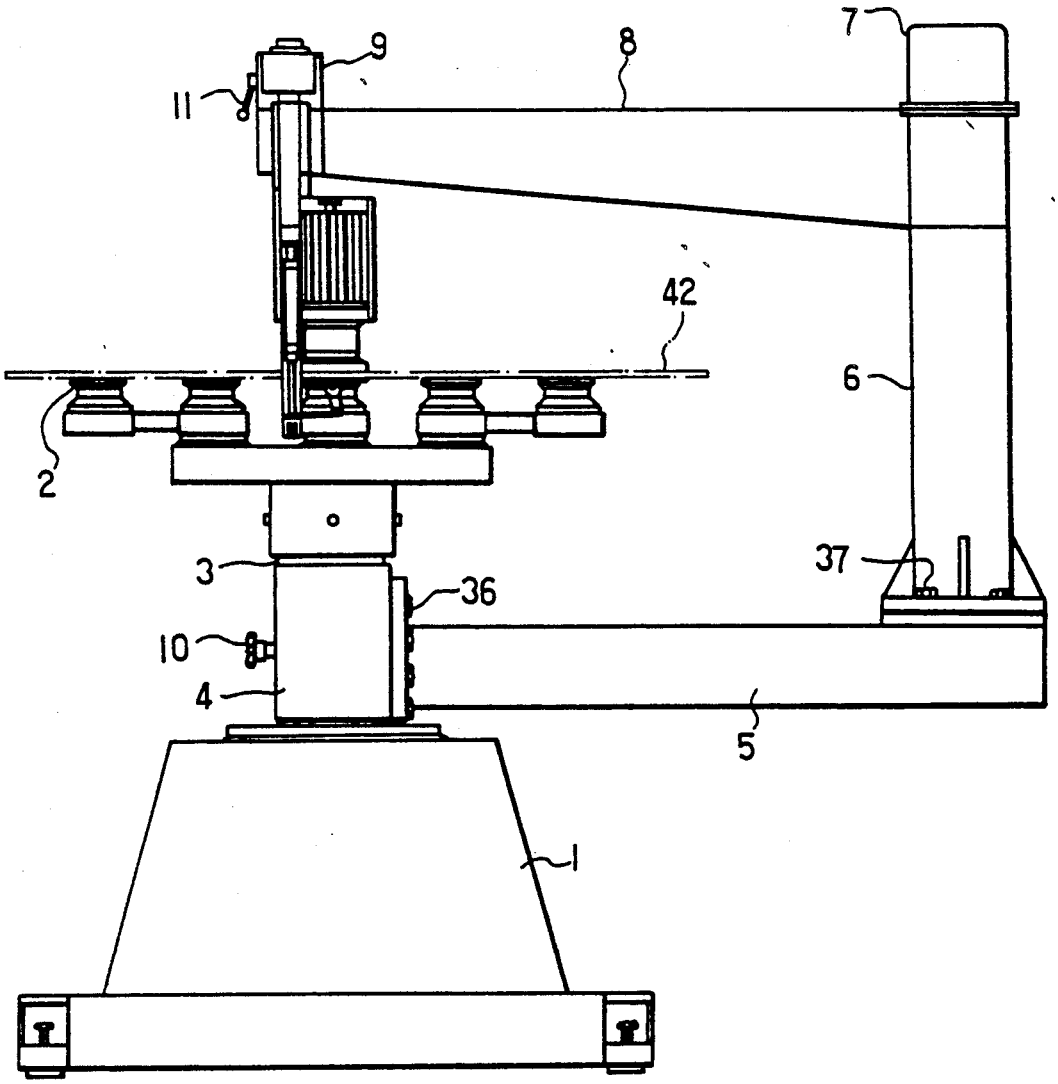
FIG. 2(B) is a right side elevational view illustrating the machine of the present invention.
Figure 2C:
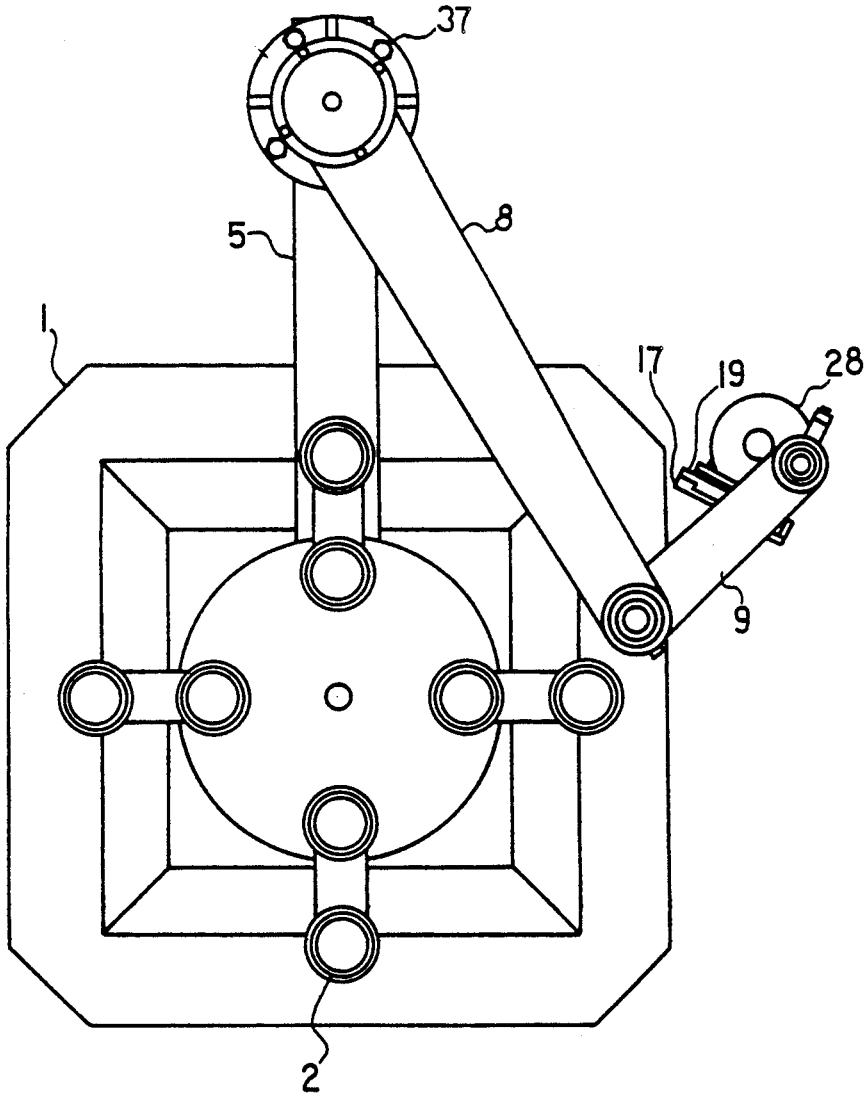
FIG. 2(C) is a top plan view illustrating the machine of the present invention.

In FIG. 2(A) and FIG. 2(B) are shown a front elevational view and a right side elevational view, respectively, of an edging-bevelling machine constructed in accordance with the principles of the present invention. A rotation sleeve or body (4) with a working position fixing handle (10), is rotatably mounted on the circumference of a center shaft (3) between a main body (1) and glass holding means (2) of the edging-bevelling machine. On one side of the rotation body (4), a horizontal beam (5) is secured by bolts (36). A lower end of a hollow and vertical beam (6) is tightly fixed by bolts (37) on the upper surface of the outer end of horizontal beam (5). On the upper end of the vertical beam (6), a rotation sleeve or cylinder (7), horizontally attached to first articulated beam (8), is rotatably mounted. A second articulated beam (9) is horizontally and rotatably mounted on the upper side of the other end of the first articulated beam (8). A fixing handle (11) is provided on the outer side of the beam (9).

Further, as most clearly shown in FIG. 2A, on the upper side of a bevel angle control-fixing plate (15) in which a long transverse slot (15*a*) is formed, an upwardly projecting rotation shaft (15*b*) is connected, and inserted in the lower side of the other end of said second articulated beam (9).

Figure 3A:
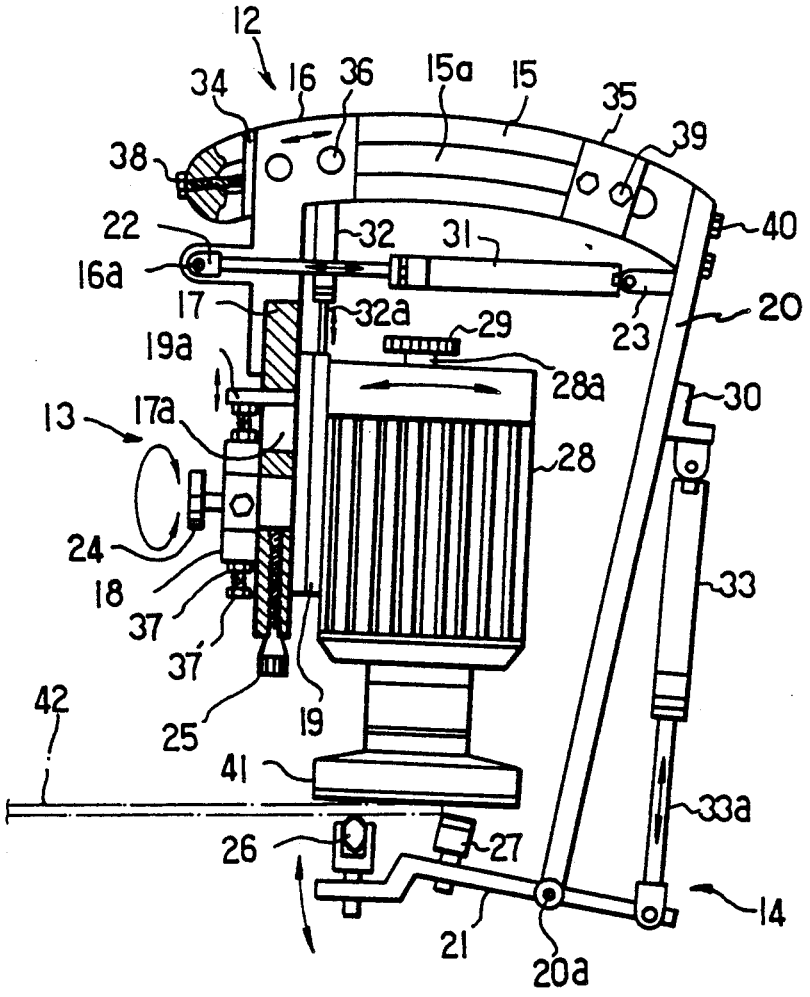
FIG. 3(A) is an enlarged sectional view of the "A" portion of FIG. 2(A)

As shown in FIG. 3A, two stoppers (34) and (35) are tightly fixed with bolts (38, 39) and nuts on respective sides of the long hole (15*a*), and a slope control plate (16) is supportedly disposed by two bearings (36) between the stoppers (34) and (35).

A supporting plate (20), which mounts a pivot shaft (20*a*) on one side of its lower end, is tightly fixed by bolts (40) to one end of plate 15. A pivotable piece (22) pivotably mounted on shaft (16*a*) on one side of the slope control plate (16), is connected with the piston of an air cylinder (31). The other end of cylinder (31) is connected by linking member (23) to plate (20). In this fashion, a bevel angle setting and control means (12) is formed.

Figure 3B:
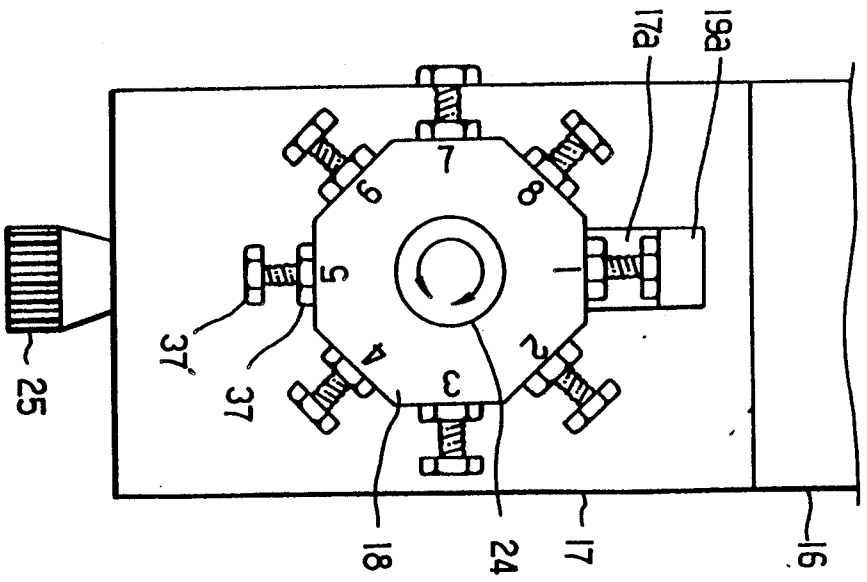
FIG. 3(B) is an enlarged left side view for the "A" portion.

Further, on the lower part of the slope controlling plate (16), a guide groove and a guide plate (17), in which a long vertically extending hole (17*a*) is formed, are attached. An octagonal height control plate (18) with attached handle (24) is rotatably mounted on one side of guide plate 17. As shown in FIG. 3B, the side faces of octagonal control plate (18) support nuts (37) for receiving bolts (37') of different heights. A control bolt (25) which serves to allow or prohibit rotation of control plate (18) is mounted in the lower part of the guide plate (17). A slider (19), on which is formed protrusion (19*a*) to come into contact with bolts (37') through the long hole (17*a*), is slidably mounted on the other side of guide plate 17. The upper part of slider 19 is connected to a piston (32*a*) of an air cylinder (32) attached to the slope control plate (16). On the inner side of the slider (19), a motor (28) is attached. A handle (29) is fixed on the upper end of shaft (28*a*) projecting from the upper side of the motor (28), and on the lower part of the motor (28), a abrasive grinding (i.e. diamond wheel) (41) is attached to the motor (28). In this way, a diamond abrasive grinding wheel height control means (13) is formed.

A roller supporting arm (21) is rotatably mounted on shaft (20*a*) at the end of supporting plate (20). A sagging-prevention roller (26) which is nondirectional and tapered on the upper end of one side, and a space maintaining roller (27) are attached to arm (21). The rollers (26) and (27) are positioned below the diawheel (41). An air cylinder (33) is attached on the outer side of the plate (20) by bracket (30). A piston (33*a*) of air cylinder (33) is attached to an outer end of roller supporting arm (21). In this way, a roller positioning mechanism (14) is provided.

As described above, the rotation cylinder (7), the first and second articulated beams (8, 9), and the bevel angle control meanns (12) and the height control means (13), as major operational parts, are disposed, according to the present invention, at a higher elevation than the flar glass (42), and when the glass (42) is edged and bevelled, the resulting glass powder and diamond abrasive grinding wheel powder do not fall within these major operational parts.

To begin operation, the working position fixing handle (10) and the position fixing handle (11) for the second articulated beam (9) are released and the flat glass (42), which is to be edged and bevelled is placed on the upper surface of the glass holding equipment (2). Then the horizontal beam (5), the vertical beam (6), the first articulated beam (8) and the second articulated beam (9) are rotated to bring the diamond abrasive grinding wheel (41) into position. When the flat glass (42) is edged and bevelled with the diawheel (42), the glass powder and powder do not fall within the major operational parts, and instead fall towards the bottom of the machine.

Figure 4:
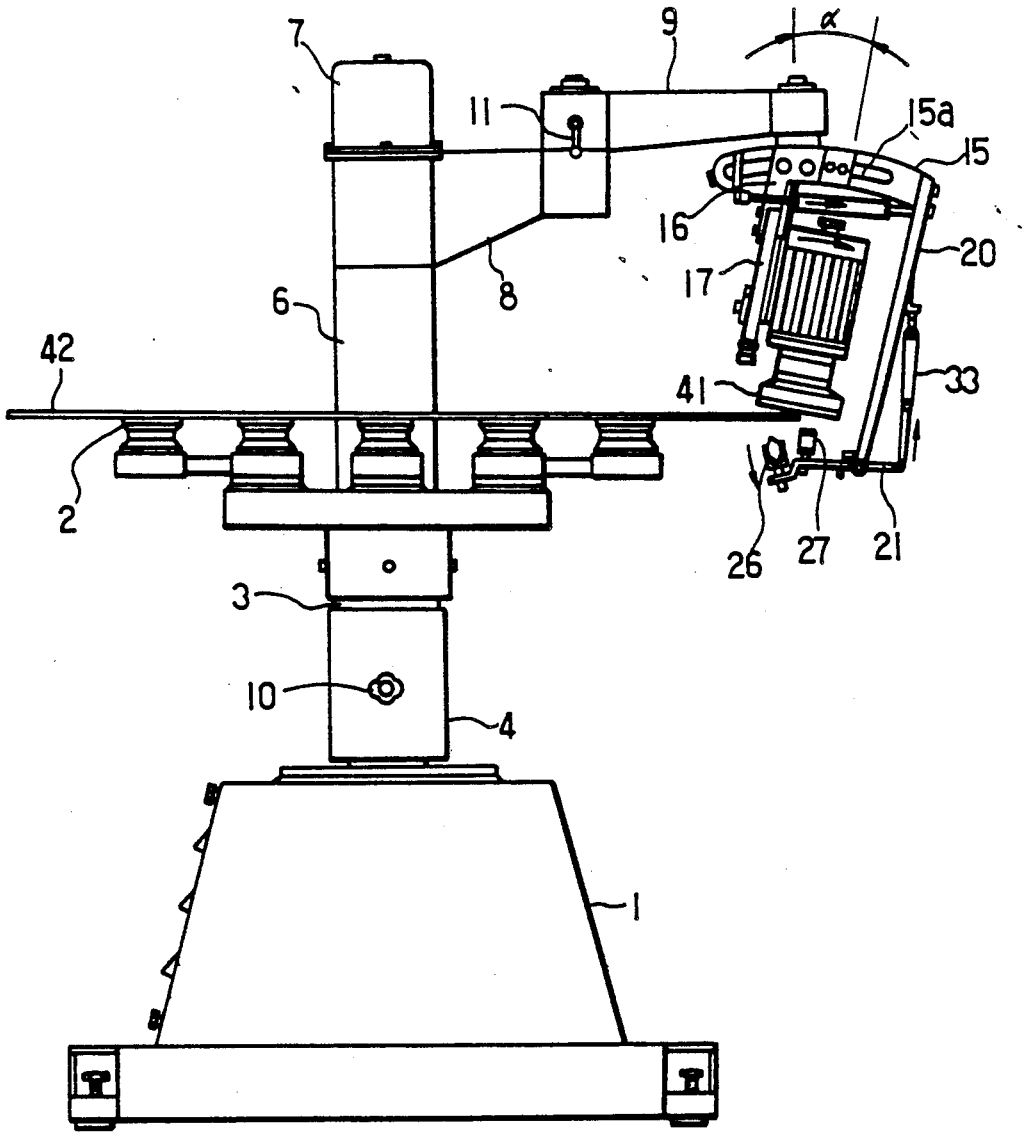
FIG. 4 and FIG. 5 are front elevational views illustrating operational states of the flat glass edging-bevelling machine according to the present invention.

As shown in FIG. 4, hen the bevel angle is adjusted, the air cylinder (33) on the outer side of the supporting plate (20) is driven to rotate the roller supporting end of arm (21) away from glass (42), and bolt (39), of the stopper (35) on one side of the bevel angle control fixing plate (15), is released. Then the air cylinder (31) connected to the slope control plate (16) is operated, and the slope control plate (16) is permitted to come into close contact with the stopper (35) so that a desired bevel angle can be set.

At those times, when the slope control plate (16) touches the stopper (34) of the left side, the axis of the motor supporting the diamond abrasive grinding wheel (41) is maintained at a right angle to the flat glass (42).

Figure 5:
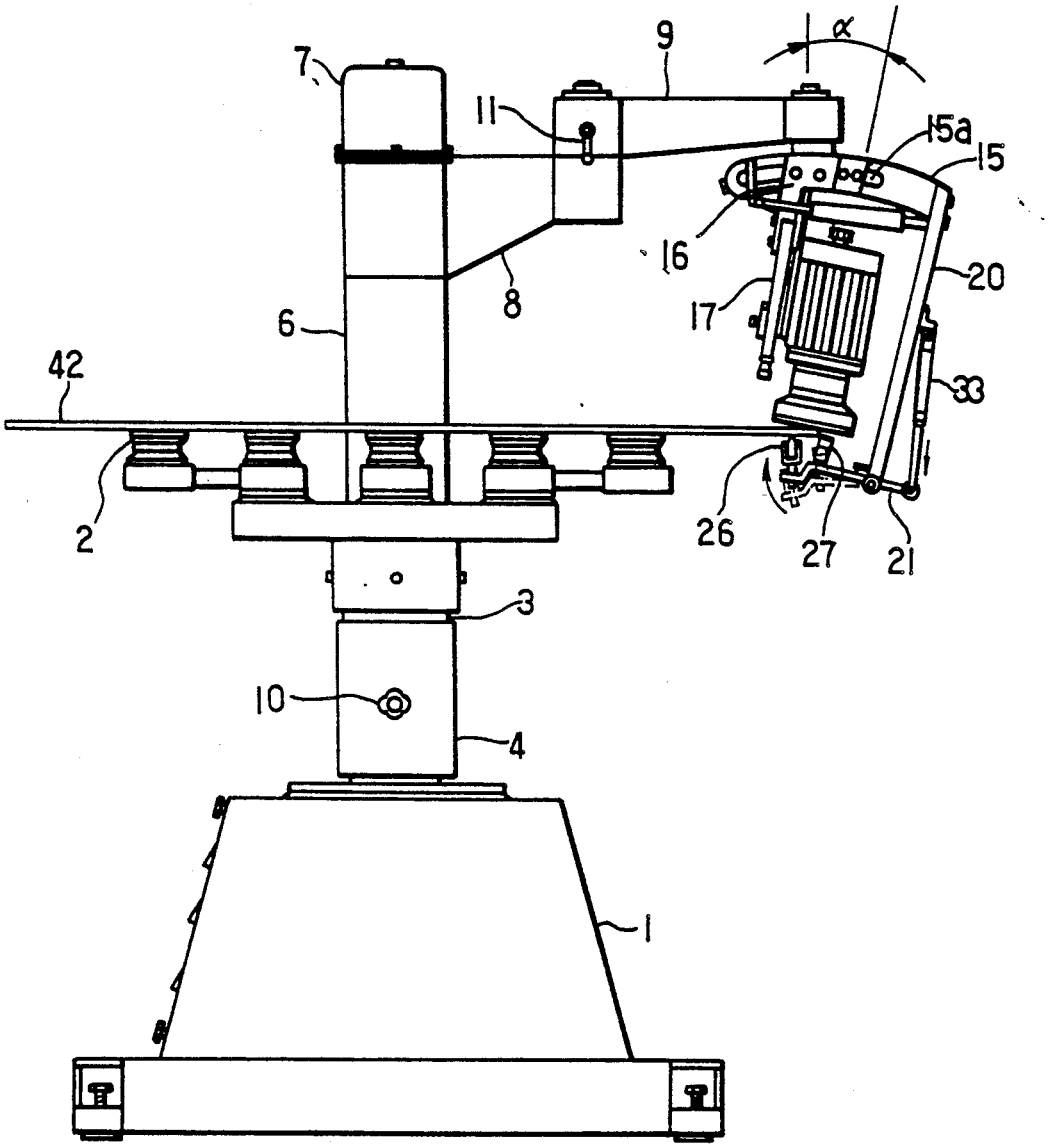

Thus, with the bevel angle ($\alpha$) set and controlled, after the diamond abrasive grinding wheel (41) is touched on the corner part of the flat glass (42), as shown in FIG. 5, the air cylinder (33) on the outer side of the supporting plate (20) is operated in the reverse direction to bring the sagging-prevention roller (26) into a position in which it supports the lower side of flat glass (42) and the motor (28) is operated. Then the flat glass (42) is permitted to be edged and bevelled.

When the flat glass (42) is edged and bevelled, the end of the sagging-prevention roller (26) is sharply formed, and because the touched area is small, cracks or flaws on the flat glass (42) are not produced.

Height adjustment of diamond abrasive grinding wheel (41) is effected by rotating said control plate (18) and selecting an adequate bolt (37)' corresponding to the diamond abrasive grinding wheel (41) in use, namely the selection of bolts (37') is done by inverse proportion of the height of bolt (37') against the thickness of diamond abrasive grinding wheel (41) in use.

Figure 6:
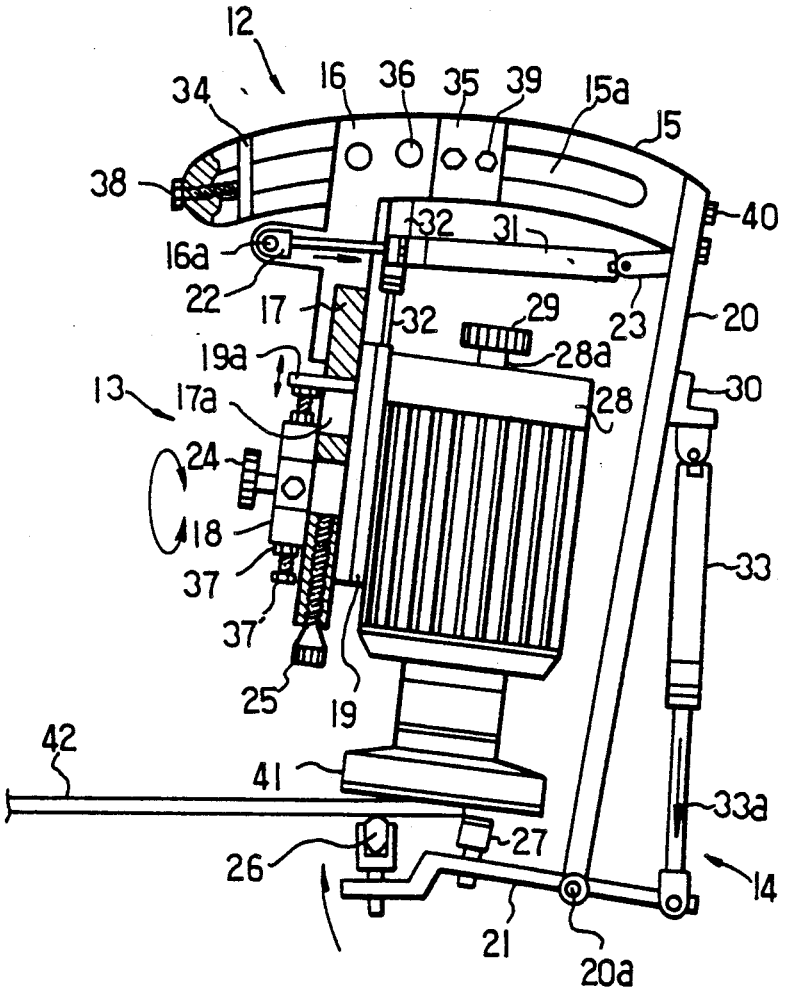
FIG. 6.
Figure 7:
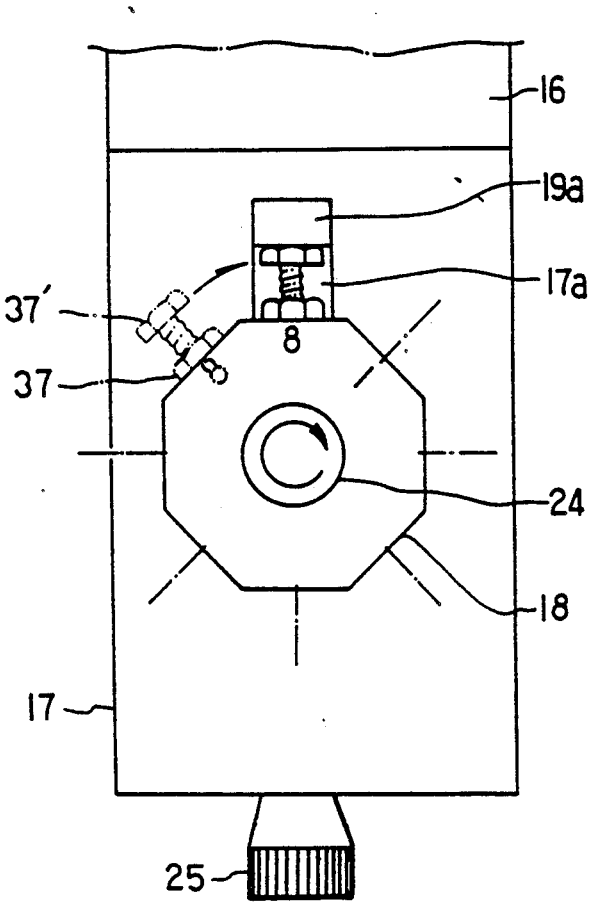
FIG.7 are a front elevational view and a side view, respectively, showing operations for controlling height of the diawheel of the flat glass edging-bevelling machine according to the present invention.

As shown in FIG. 6 and FIG. 7, when the flat glass (42) is edged and bevelled, the handle (24) is turned in the clockwise direction, and the bolt (37'), which is adjusted to be suitable for the diawheel (41) to be used, is positioned near the lower part of the protrusion (19*a*).

Next, the slider (19) is made to descend downwardly by the air cylinder (32) attached to the lower part of the slope control plate (16) until the protrusion (19*a*) is stopped and rests on the bolt (37') and the slider (19) cannot descend further. Accordingly, the height of the diamond abrasive grinding wheel (41) is automatically adjusted, e.g. in connection with the replacement of a worn diamond abrasive grinding wheel (41).

Figure 8A:
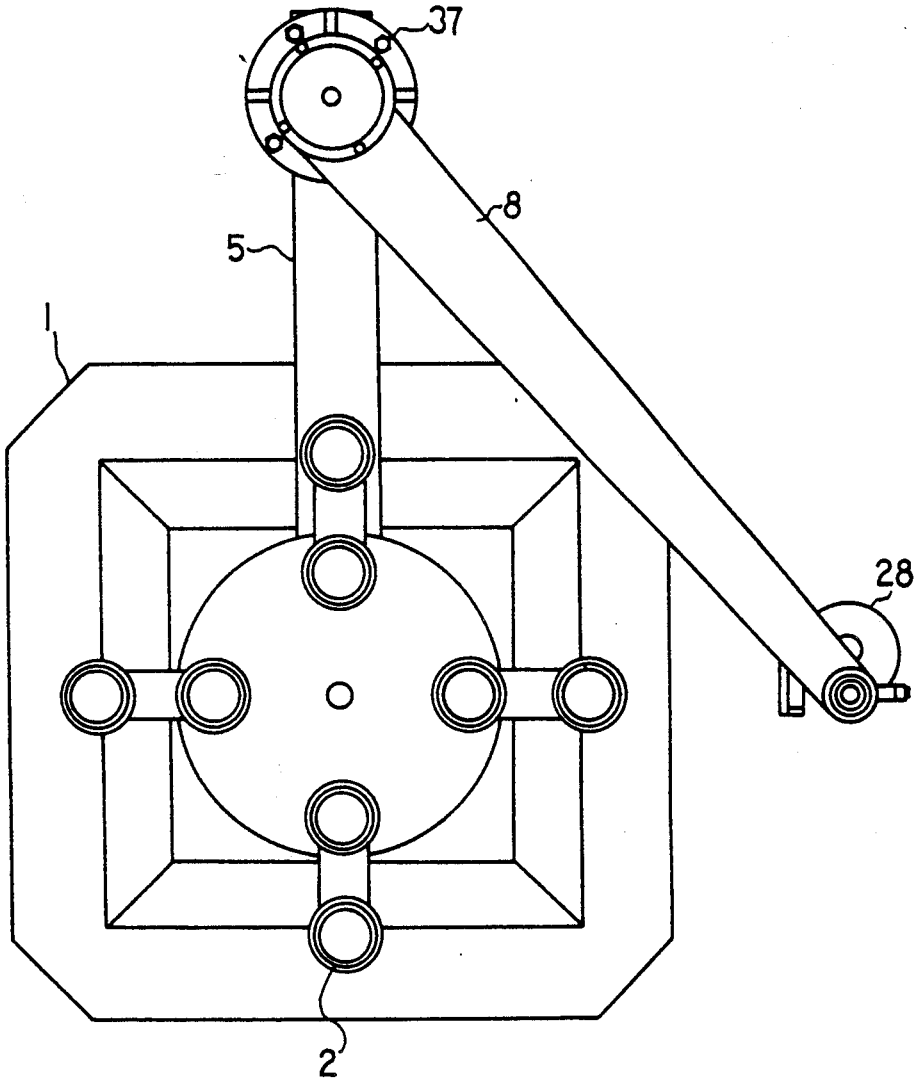
FIG. 8(A), FIG. 8(B) and FIG. 9 are detailed views of other forms of the machine constructed in accordance with and embodying the present invention.
Figure 8B:
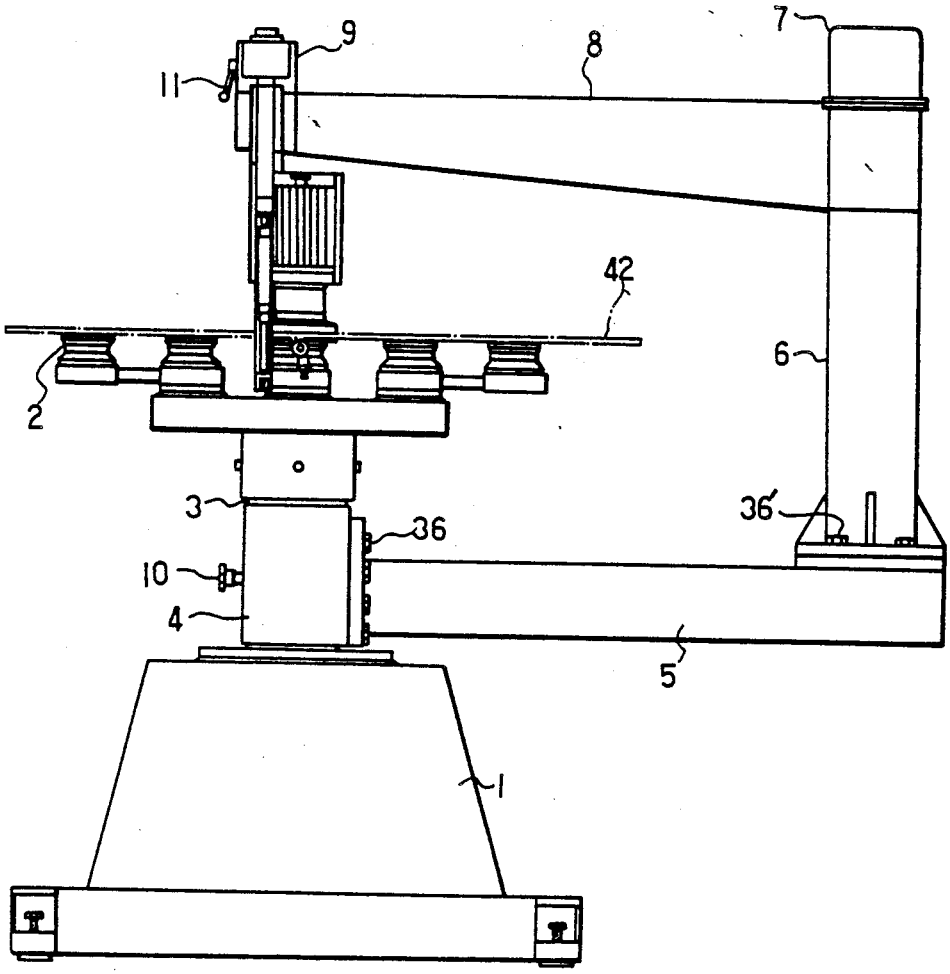
Figure 9:
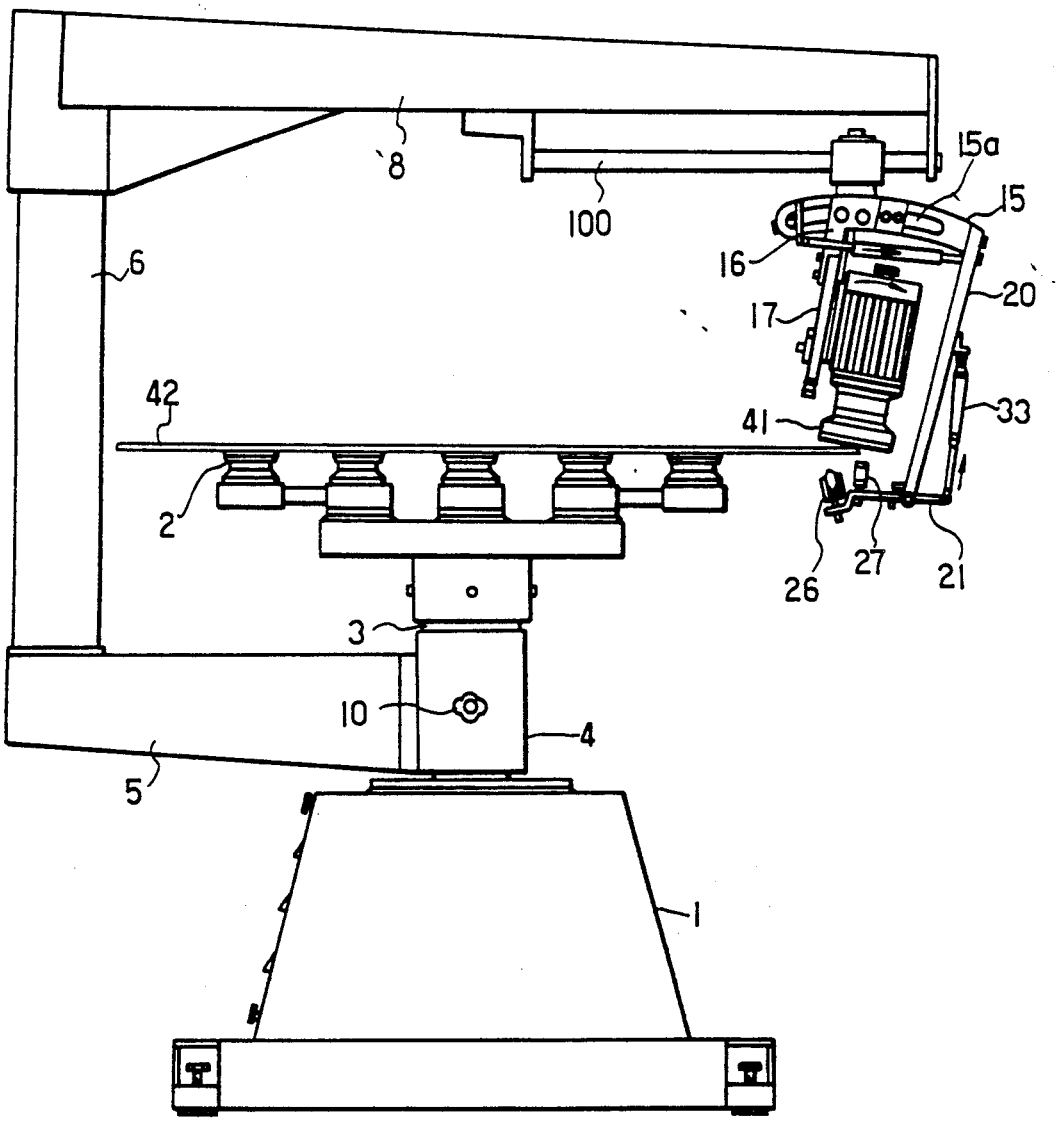

In FIG. 8 and FIG. 9 are shown other examples of the flat glass edging-bevelling machine constructed according to the present invention. In FIG. 8 is shown a machine in which the rotation shaft (15*b*) of the bevel angle control means is directly mounted on the end of the first articulated beam without use of the second articulated beam. FIG. 9 is a view of an embodiment in which two separate rails (100) are located on the lower part of the remote end of the first articulated beam (8) and the rotation shaft (15*b*) of the bevel angle control means is permitted easily to move along said rails.

In the latter two examples, the major operational parts such as the bevel angle control means (12), the diawheel height control means (13) and the air cylinder (33) of the sagging prevention roller driving means (14), including the major articulated parts, are also disposed higher than the flat glass, and have the same effects as in the earlier example.

As described in greater detail above, in the present invention, the vertical beam (6) is installed on the end portion of the horizontal beam (5) of the flat glass edging-bevelling machine, and the first articulated beam (8) or the second articulated beam (9) is set higher than the glass holding means (2), and the bevel angle control means (12), the height control means (13) of the diamond abrasive grinding wheel, and the sagging-prevention roller positioning mechanism (14) are disposed directly at the end of an articulated beam or on the rail (100).

Accordingly, the major operational parts of the machine are set higher than the flat glass (42), and the flat glass powder and the diamond abrasive grinding wheel powder which are produced in edging and bevelling the glass are not allowed to fall on the major articulated parts, and the slope control plate (16) adjusting the bevel angle ($\alpha$) is rotatably moved about the center of the diamond abrasive grinding wheel (41) between the stoppers (34, 35) while supported on the bevel angle control fixing plate (15), whereby the bevel angle can be adjusted and there is no change in the height of the (41) and the bevel width.

Accordingly, when the bevel angle is controlled it is not necessary to control the height of the diamond abrasive grinding wheel (41) separately.

Further, the height degree of the (41) is controlled in advance, using the height control plate (18) and protrusion (19*a*), e.g. whenever the diamond abrasive grinding wheel (41) is exchanged.

Further, because the (41) is directly attached to the motor shaft (28*a*), and production of noise and vibration can be prevented, the cutting surface of the flat glass (42) is smooth and fine and the contact area of the flat glass (42) can be minimized by the tapered roller (26) for prevention of sagging.

Accordingly, cracks or flaws on the flat glass (42) can be prevented and the quality of the flat glass (42) can be improved and advanced.

The embodiments of the invention in which an exclusive property or privilege is claimed are defined as follows:

1. A flat glass edging-bevelling machine in which a flat glass is placed on the surfaces of holding means located above a main body and the flat glass is edged-bevelled with a diamond abrasive grinding wheel connected to a motor, comprising:

a horizontal beam rotatably mounted on a vertical center shaft between a main body and glass holding means, said beam extending away from said shaft;

a vertical beam secured to an end of said horizontal beam remote from said shaft;

articulated beam means supported by said vertical beam in a position higher than the glass holding means in height;

a bevel angle control means, a grinding wheel height control means and a positioning means for selectively varying the positon of a sagging-prevention roller, all connected to the articulated beam means by a rotational shaft; and wherein at least the bevel angle control means and grinding wheel height control means of said machine are disposed higher than a flat glass supported on said glass holding means.

2. The machine of claim 1 wherein said bevel angle control means comprises:

a slope control plate supporting said grinding wheel which plate is disposed for movement along a long hole in a bevel angle control-fixing plate such that said movement causes the slope control plate to rotate about a center of the grinding wheel, and stoppers which limit the moving distance of the slope control plate along said long hole, at least one of said stoppers being adjustable in position along said hole, and an air cylinder for selectively moving the slope control plate between said stoppers, whereby the bevel angle is controlled.

3. The machine of claim 1 wherein said grinding wheel height control means comprises:

a rotatable height control plate having control bolts of different heights extending radially therefrom, said height control plate being rotatably mounted on one side of a guide plate; and a protrusion formed on a slider which protrusion extends through a long hole of said guide plate, the slider being located on an opposite side of said guide plate from said height control plate, the slider supporting the grinding wheel, whereby the height of the grinding wheel is controlled by contacting the protrusion with an appropriate control bolt when the height control plate is rotated.

4. The machine of claim 1 wherein said sagging-prevention roller has a tapered central circumferential surface to minimize contact area with the flat glass; and said positioning means comprises an actuator for moving said roller into and out of contact with the glass.

5. The machine of claim 1 wherein said articulated beam means comprises a first articulated beam rotatably mounted to the top of vertical beam and wherein said bevel angle control means, said grinding wheel height control means and said positioning means for the sagging-prevention roller are disposed on a remote end of the first articulated beam, and major operational areas of said machine are arranged higher than the flat glass.

6. The machine of claim 1 wherein said bevel angle control means, said grinding wheel height control means and said positioning means for the sagging-prevention roller are movingly disposed on a rail arranged on the lower end of the articulated beam means, and major operational areas of the machine are disposed higher than the flat glass.

7. The machine of claim 1 wherein said articulated beam means comprises a first articulated beam rotatably mounted to the top of said vertical beam and a second articulated beam rotatably mounted to a remote end of said first articulated beam and wherein said bevel angle control means, said grinding wheel height control means and said positioning means for the sagging-prevention roller are disposed on a remote end of the second articulated beam and major operational areas of said machine are arranged higher than the flat glass.

* * * * *